United States Patent [19]

Faller

[11] 4,221,320

[45] Sep. 9, 1980

[54] COMPOSITE INCLUDING TRAY RESTRAINED WITH OUTER COVER

[75] Inventor: Rudolph A. Faller, Edina, Minn.

[73] Assignee: Champion International Corporation, Stamford, Conn.

[21] Appl. No.: 28,235

[22] Filed: Apr. 9, 1979

[51] Int. Cl.[3] ..... B65D 5/38; B65D 25/00

[52] U.S. Cl. ..... 229/19; 229/9; 229/40; 426/106

[58] Field of Search ..... 229/9, 10, 11, 19, 20, 229/40; 426/106; 220/345

[56] References Cited

U.S. PATENT DOCUMENTS

| | | | |
|---|---|---|---|
| 2,617,577 | 11/1952 | Tardiff | 229/19 X |
| 2,790,589 | 4/1957 | Moore | 229/19 |
| 3,126,444 | 3/1964 | Taylor | 220/345 X |
| 3,281,051 | 10/1966 | O'Brien et al. | 229/40 X |
| 3,395,849 | 8/1968 | Gillar | 220/345 X |
| 3,648,918 | 3/1972 | Van Inwagen | 229/9 X |
| 3,650,383 | 3/1972 | Nigro | 229/9 X |
| 3,759,720 | 9/1973 | Young | 229/9 X |
| 3,986,658 | 10/1976 | Arneson et al. | 229/40 |
| 4,013,798 | 3/1977 | Goltsos | 229/9 X |

FOREIGN PATENT DOCUMENTS

| | | | |
|---|---|---|---|
| 192226 | 8/1918 | Canada | 229/11 |
| 1433134 | 2/1966 | France | 229/9 |

*Primary Examiner*—Davis T. Moorhead
*Attorney, Agent, or Firm*—Evelyn M. Sommer

[57] ABSTRACT

A low cost paperboard package includes a tray with bendable flanges protected by an outer cover member. In one embodiment, a wrap-around blank comprising a generally rectangular paperboard tube protects the tray prior to use. In another embodiment, a folded carton with end wall panels protects the tray prior to use. In both embodiments, the movement of the tray within the outer cover member is restrained by the coaction of the outer cover member and the spring action of the bendable tray flanges. The distance between the side walls of the outer cover member is less than the distance between the outer edges of the tray flanges when they are fully extended. By bending the flanges downwardly, the tray can be slipped into a blank of minimal size. The friction between the tray flanges and the blank's side walls resists movement of the tray.

13 Claims, 8 Drawing Figures

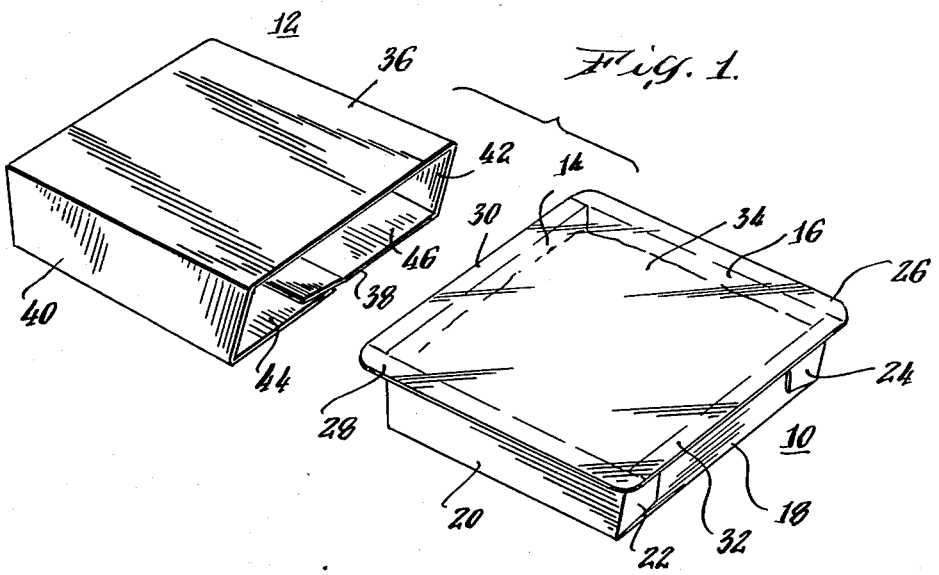
Fig. 1.
Fig. 2.
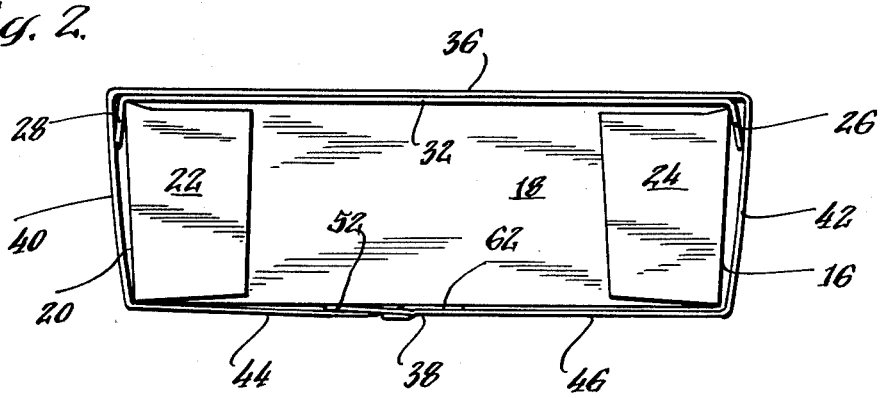
Fig. 3.
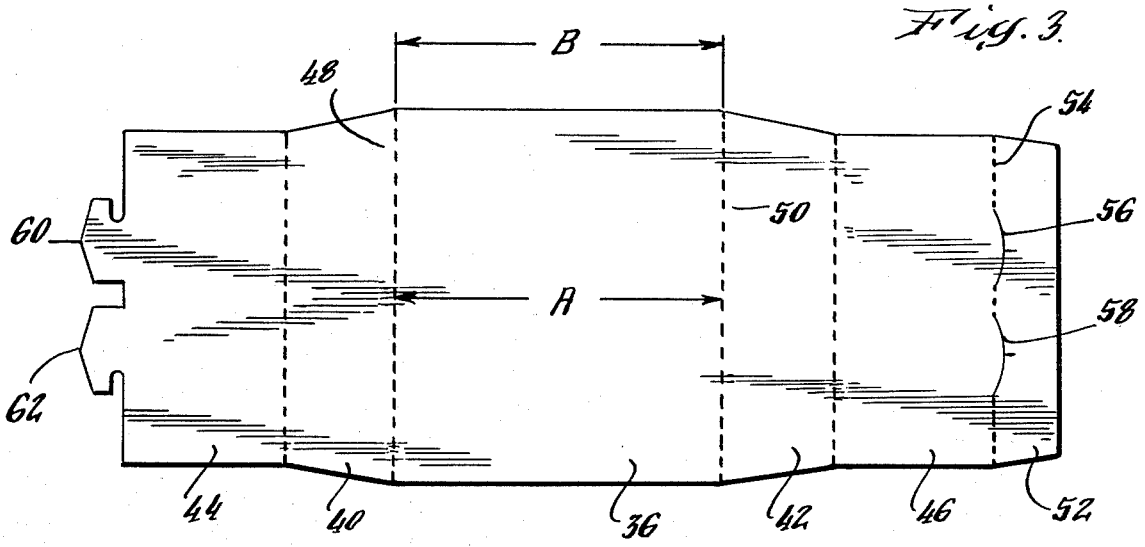

COMPOSITE INCLUDING TRAY RESTRAINED WITH OUTER COVER

BACKGROUND OF THE INVENTION

The present invention relates to packages and more particularly to a package comprising a tray and an outer protective cover.

Many products are merchandised in sealed cartons in high volumes but at a relatively low profit margin on a per carton basis. Frozen foods, such as vegetable entrees or complete dinners which are packaged in closed cartons before freezing, are representative of such high volume, low profit margin products.

The packaging operation by which such products are sealed in individual cartons should be highly automated and should employ low cost materials to reduce the packaging costs without reducing the integrity of the package seal. Paperboard is strong and relatively inexpensive, and therefore highly suitable for many packaging applications.

Conventionally, frozen food products have been marketed in completely closed outer cartons which are torn open by a consumer in order to reach the sealed tray containing the frozen food product. The outer cartons are generally thrown away when the frozen food product is reheated in either a conventional or a microwave oven.

Other products would also be adaptable to marketing in trays, but preferences dictate placing the trays in outer cartons. Where the products are breakable in nature, such as with pie crusts, potato chips, and the like, trays which are permitted to shift within the outer carton will subject the contents to damaging impacts as they are bounced about within the carton during shipment and handling.

SUMMARY OF THE INVENTION

The present invention is an improved package for frozen food products and the like, which package employs a tray with an outer cover, wherein the movement of the tray within the outer cover is restrained by the spring action of bendable flanges acting against the outer cover walls.

The package includes a tray having a bottom wall panel with a plurality of generally upright side wall panels. At least two flanges extend outwardly from opposite side wall panels of the tray. The flanges are bendable about the fold lines which define their boundaries with the side wall panels. The package further includes an outer cover which comprises at least top and bottom wall panels connected by side wall panels. The distance between the side wall panels of the outer cover is less than the distance between the outer edges of the tray flanges when the flanges are fully extended. When the tray flanges are bent downwardly, the tray can be pushed into the outer cover where it is retained by the resilience of the flange and the friction between the flanges and the side wall panels of the outer cover. By virtue of the the minimal spacing between side wall panels of the outer cover and the outer edges of the tray flanges, the volume defined by the cover is minimized thereby reducing material costs and increasing the number of packages that may occupy a given space.

In one embodiment, the outer cover comprises a "wrap-around blank". The term "wrap-around blank" as used herein is intended to designate a wrap around holder, i.e. a rectangular tube into which the tray is inserted and securely retained. The term "wrap-around blank" is also intended to designate the embodiment of a flat piece of paperboard which may be hand or machine erected around the tray.

In another embodiment, the outer cover comprises a carton having end wall panels as well as side wall panels. Thus, the term "carton" as used herein is intended to designate a cover having top and bottom wall panels connected by side wall panels and also having end wall panels.

The use of flanges on the tray is a significant feature of the invention since they tend to suspend the tray inside the cover thereby protecting the package and contents thereof from damage as a result of shock or vibration during shipping. Moreover, the flanges immobilize the entire tray to prevent movement of the latter within the cover during handling and shifting of the package by consumers in the marketplace.

DESCRIPTION OF THE DRAWINGS

While the specification concludes with claims particularly pointing out and distinctly claiming that which is regarded as the present invention, further details of preferred embodiments of the invention may be more readily ascertained from the following detailed description when read in conjunction with the accompanying drawings wherein;

FIG. 1 is a perspective view of a tray and wrap-around blank constructed in accordance with the present invention;

FIG. 2 is an end view of a package constructed in accordance with the present invention;

FIG. 3 is a plan view of a blank for one kind of wrap-around blank that might be used in practicing the present invention;

DETAILED DESCRIPTION

Figure 4:
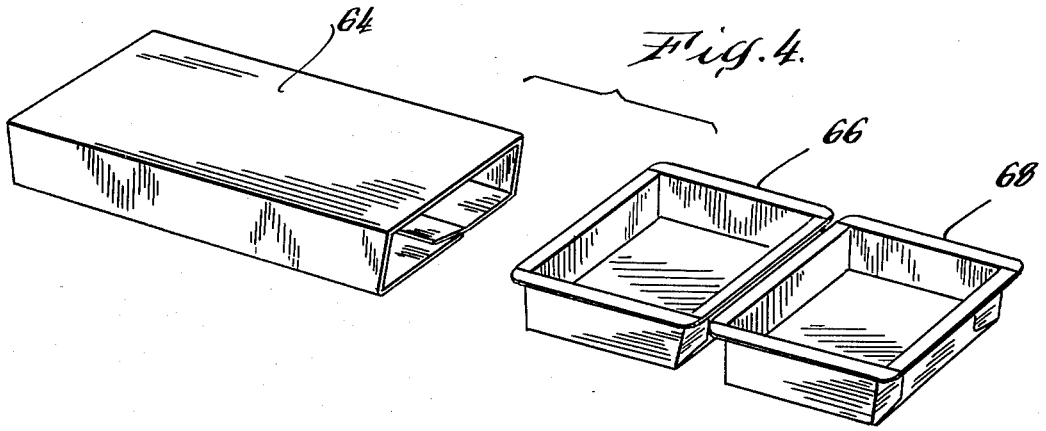
FIG. 4 is a perspective view of an alternate embodiment of the invention.

Referring to FIG. 1, a package according to one embodiment of the present invention is shown which includes a tray 10 and an outer cover member in the form of a generally rectangular wrap-around blank 12. Tray 10, which is preferably made from a low cost foldable material such as paperboard, includes a bottom wall panel (not shown) and a plurality of generally upright side wall panels 14, 16, 18, 20 which are preferably integral with the bottom wall panel. The side wall panels may be secured by conventional methods such as trapezoidal glue flaps 22 and 24.

A first pair of flanges 26 and 28 extend outwardly from the upper edges of opposing side wall panels 16 and 20, respectively. The flanges 26 and 28 are bendable about the fold lines at the upper edges of these side wall panels. In one embodiment of the invention, generally rectangular flanges 30 and 32 extend outwardly from the upper edges of side wall panels 14 and 18, respectively. In this embodiment, the flanges 26 and 28 are not joined to flanges 30 and 32. Instead, the ends of the flanges 30 and 32 abut adjacent edge of the flanges 26 and 28.

Depending upon the nature of the product to be placed in tray 10, the interior of the tray may be untreated or a coated paperboard. Alternatively, the tray may be lined with a film liner inserted into the tray or formed in place. The contents of the tray are protected by an inner cover member which, in the embodiment shown in FIG. 1, is a flexible film 34 which overlies the entire tray and is bonded to each of the flanges thereof by heat sealing techniques or suitable adhesives.

The wrap-around blank 12 for tray 10 includes a top wall panel 36, a bottom wall panel 38 and connecting side wall panels 40 and 42. As will be seen more clearly later, the bottom wall panel 38 is actually made up of two smaller panels 44 and 46 which extend inwardly from the side wall panels 40 and 42 to a connecting area near the midpoint of the bottom panel 38.

Referring to FIG. 2, the distance between the side wall panels 40 and 42 of the generally rectangular blank 12 is greater than the distance between the side wall panels 16 and 20 of the tray 10, but less than the distance between the outer edges of flanges 26 and 28 when those flanges are in their fully extended or horizontal positions. To fit tray 10 into blank 12, the flanges 26 and 28 are bent downwardly about their fold lines as the tray is guided into the blank. When the tray is in place, the flanges 26 and 28 tend to move outwardly against the side wall panels 40 and 42 of the blank 12 due to the natural resiliency of the paperboard material and to the tensioning effect of any film covering the tray 10. The surfaces of the flanges 26 and 28 engage the inner surfaces of the side wall panels 40 and 42 to provide a frictional force which resists movement of the tray 10 relative to the blank 12. Another advantage of the invention resides in the reduced tendency for leaks to occur near the corners of the tray flanges where the flanges from adjacent sides meet. The plastic inner cover member is tensioned over these corner areas upon insertion into the outer cover, thereby reducing the tendency for leaking in those areas.

Although the side wall panels of the tray 10 are shown in FIG. 2 as being essentially straight or perpendicular with respect to the bottom wall panel 38, such side wall panels may also be tapered with respect to the tray's bottom panel (even though not specifically illustrated herein). In such case, while the wrap-around blank 12 will be designed correspondingly i.e., to accommodate the tapered tray, the principles of fit and retention will be the same as for the above described generally rectangular embodiment. Similarly, the blank just described as an erected article may be erected around the tray into the wrap-around blank.

FIG. 3 illustrates one way of securing the panels 44 and 46 which, taken together, form the bottom wall panel 38 of the wrap-around blank. Panel 46 includes a generally trapezoidal flap 52 extending from a score line 54. A pair of arcuate cuts 56 and 58 are provided in the panel material at the score line 54. At the opposite edge of the blank, panel 44 carries a pair of generally J-shaped members 60 and 62. When the blank is erected into a wrap-around blank, the panel 46 is first folded into a position parallel to but spaced from the top panel 36. When panel 44 is folded into the same position, the J-shaped members 60 and 62 are inserted through the arcuate cuts 56 and 58, respectively, to lock the panels 44 and 46 together. Flap 52 overlaps panel 44 within the rectangular tube formed by the panels.

In an alternate embodiment, one surface of the flap 52 might be coated with a suitable adhesive to allow flap 52 to be bonded to the inner surface of panel 44 in the area of overlap.

The preceding figures have shown a wrap-around blank which accommodated a single tray. Referring to FIG. 4, it may be advantageous for some uses to provide a single blank 64 for receiving two or more trays, such as trays 66 and 68. The trays 66 and 68 would be of the same width but not necessarily the same length. If the package were to be used to hold frozen food products, different frozen foods would be loaded into the individual trays. The individual trays would permit the manufacturer to provide a dinner in which one frozen food is to be reheated in a conventional or microwave oven while the other frozen food is to be served cold.

The use of individual trays would also permit a manufacturer to "customize" his product by combining a single pre-packaged entree with different pre-packaged side dishes without changing over any production lines. For such uses, the individual trays 66 and 68 would be separately sealed by overlying films.

Figure 5:
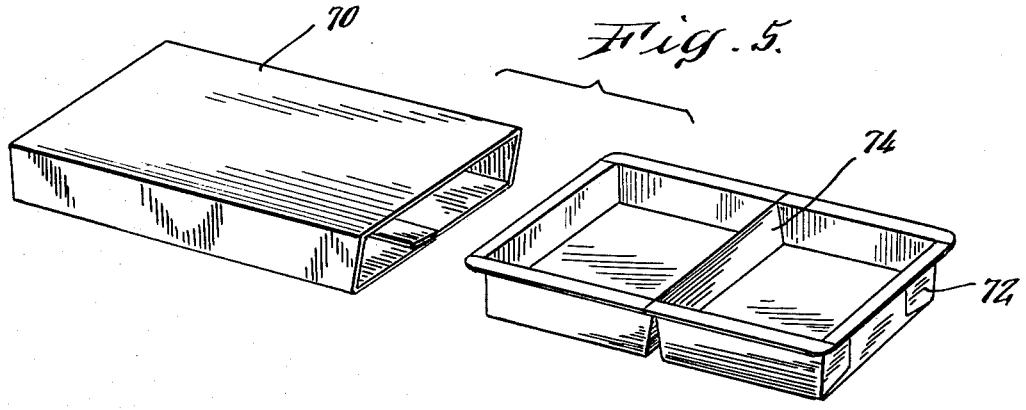
FIG. 5 is a perspective view of still another embodiment of the invention.

For other uses, a single multi-compartmented tray or individual trays with a single overlying film might be carried within a wrap-around blank. Referring to FIG. 5, the wrap-around blank 70 would carry a relatively long tray 72 having a central divider 74. A tray such as this might be used in packaging frozen dinners in which all of the different foods are to be reheated before serving.

Figure 6:
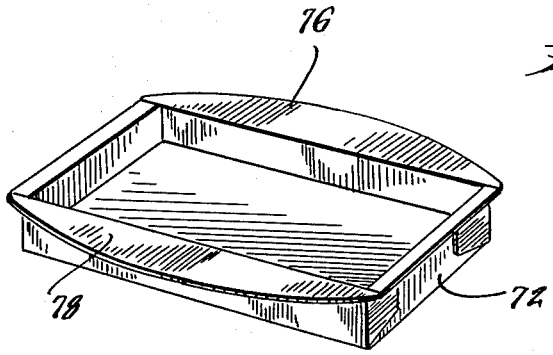
FIG. 6 is a perspective view of an alternate kind of tray which can be employed in a wrap-around blank or carton according to the present invention.

For some uses, especially where the tray is meant to hold a relatively heavy food product for heating, it may be advantageous to form two of the upper tray flanges in the shape of handles. A tray having this configuration is shown in FIG. 6. Preferably the handles 76 and 78 will be along the major dimension as shown. While the handles could be on the minor dimension, this is not preferred because the strength would not be as great. Also, apertures may be provided in the handles 76 and 78 to aid in gripping the tray, however, in the case of weaker paperboard constructions, this may not be desirable since the structural strength of the handles 76 and 78 would be reduced. In this embodiment the tray will be inserted into the outer cover member by bending the handles downwardly as has been described previously with regard to the flanges of conventional construction.

In addition to protecting the tray contents during marketing, the wrap-around blanks described above, may also be used in storing unconsumed portions of the tray contents. For example, a consumer who prepares but does not eat all of a frozen food dinner can simply slide the tray with the uneaten portion back into the wrap-around blank before placing the package in a refrigerator.

Figure 7:
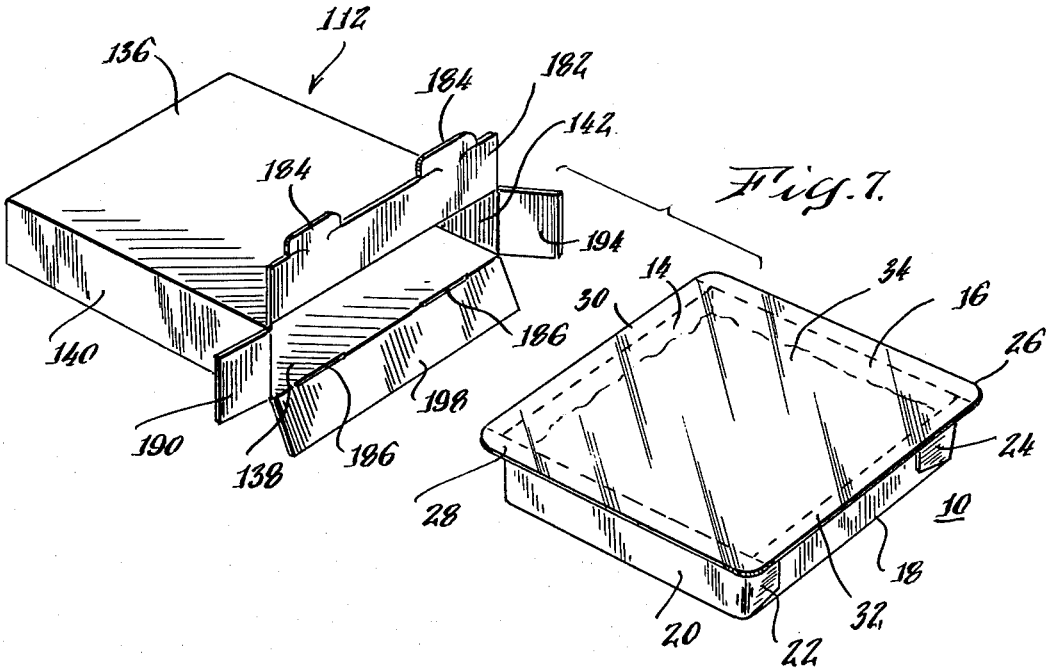
FIG. 7 is a perspective view of a tray and carton constructed in accordance with the present invention.
Figure 8:
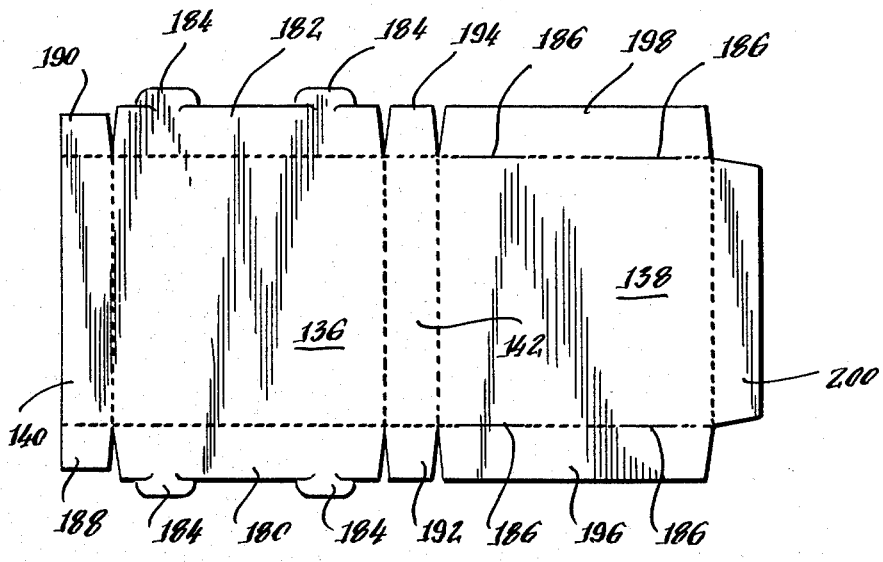
FIG. 8 is a plan view of a blank for one kind of carton that might be used in practicing the present invention.

Referring now to FIGS. 7 and 8 there is shown another embodiment of the outer cover member of the present invention. FIG. 7 shows tray 10 ready for insertion into open carton 112 by bending flanges 26 and 28 as explained earlier with regard to the embodiment employing the wrap-around blank. The tray will be of suitable construction as previously described, and is shown here in a form identical to that in FIG. 1. FIG. 8 shows a plan view of a blank for one kind of carton that might be used in practicing the present invention.

The carton shown in FIG. 7 includes a top wall panel 136, a bottom wall panel 138 and connecting side wall panels 140 and 142. Also included in the carton are end wall panels at least partially covering the remaining two sides of the carton. The carton blank shown in FIG. 8 makes the construction of the carton more apparent. The carton blank shows top panel 136, bottom panel 138 and two side wall panels 140 and 142. The dotted lines indicate fold lines which are preferably scored in conventional manner. Also shown are end wall panels 180 and 182 which are scored to extend downwardly from top panel 136. Both end wall panels are provided with edge lock tabs 184 which fit into slots 186 in the folded carton to lock the end wall panels in place. The end wall panels may also be formed with tabs 188 and 190 which extend from the side wall panel 140, tabs 192 and 194 which extend from side wall panel 142, and elongated inner flaps 196 and 198 which extend upwardly from bottom panel 138.

When erected into a carton, tab 200 is adhesively sealed to side wall member 140 to form the main body of the carton. The tray 10 is preferably inserted into the carton after adhering the tab 200 to a side wall member 140 and prior to forming the end walls by folding end wall members 180 and 182 and the associated tabs extending from the bottom and side wall panels. Instead of locking end wall panels 180 and 182 in place by means of lock tabs 184 and slots 186, member 180 can be glued or heat sealed to tab 196 and member 182 can be glued or heat sealed to tab 198.

While the embodiment of the package employing a carton is described above with regard to only one tray configuration, it is to be understood that all those tray embodiments suitable for use with the wrap-around blank can also be employed with the carton.

The packages described above can of course be used for purposes other than holding frozen food products. Frozen and non-frozen food products which are susceptible to breakage can advantageously be packaged. Further, many office products, such as paper clips, rubber bands and the like are provided in small packages. Trays of items such as these could easily be marketed in packages of the type described above. In fact, the type of package illustrated in FIG. 4 where small individual trays are loaded into a single long wrap-around blank, would be particularly advantageous as a dispenser package for such office products. The same type of multiple tray arrangement could be used where the outer cover is a carton of the type described.

An additional advantage of the present invention, regardless of its application, is that the tray or trays which are retained within the outer cover are substantially concealed from view. Therefore, a manufacturer might stock unprinted or identically printed trays for use in holding different products. Only the outer cover would be printed with marketing material unique to a particular product.

While there have been described what are considered to be preferred embodiments of the present invention, variations and modifications therein will occur to those skilled in the art once they become acquainted with the basic concepts of the invention. Therefore, it is intended that the appended claims shall be construed to include all such variations and modifications as fall within the true spirit and scope of the invention.

What is claimed is:

1. A package comprising:

a tray having a bottom wall panel, plurality of side wall panels and a first pair of flanges respectively extending outwardly from opposite ones of said side wall panels, said flanges being bendable about fold lines at the upper edges of said side wall panels from an extended position to a tucked position, the distance between respective outer edges of said first pair of flanges being reduced when the latter are bent from said extended positions thereof to said tucked positions thereof, each of said flanges being biased to return from said tucked position thereof to said extended position thereof; and a generally rectangular outer cover member including top and bottom wall panels connected by side wall panels, the distance between at least portions of said side wall panels of the outer cover member being less than the distance between the outer edges of said flanges when the latter are in said extended position thereof, said tray being insertable into the outer cover member when the flanges are bent to said tucked position thereof, said tray being retained in the outer cover member by frictional engagement produced by outward biasing of said flanges against said side wall panels of the outer cover member.

2. A package as defined in claim 1 wherein said tray further includes a second pair of flanges extending outwardly from the remaining side wall panels of said tray, each end of each flange of said second pair abutting one edge of a flange of said first pair.

3. A package as defined in claim 1 wherein said tray is sealed by an inner cover member which overlies and is bonded to the surfaces of each of the flanges, said inner cover member being movable with said flanges.

4. A package as defined in claim 1 wherein said outer cover member further includes end wall panels.

5. A package as defined in claim 1 wherein said bendable tray flanges have cut out areas and are adapted for use as handles.

6. A package as defined in claim 2 wherein said tray is sealed by an inner cover member which overlies and is bonded to the surfaces of each of the flanges, said cover member being movable with said flanges.

7. A package as defined in claim 6 wherein the inner cover member is a flexible film.

8. A package as defined in claim 7 wherein the side wall panels of said outer cover member are tapered to provide a fit with a tray having corresponding tapered side walls.

9. A package as defined in claim 7 further including at least one additional tray also having a bottom wall panel, a plurality of side wall panels and a pair of flanges extending outwardly from opposite ones of said side wall panels, all of said trays being received within and protected by the outer cover member.

10. A package as defined in claim 9 wherein each tray is sealed by a separate inner cover member to permit individual trays to be removed from the outer cover member without removing other trays.

11. A package as defined in claim 9 wherein a single inner cover member is used to seal more than one of the plurality of trays received within the outer cover member.

12. For use in combination with a tray having flanges bendable from an extended position to a tucked position, a blank for forming a generally rectangular, open-ended tube for holding the tray, said blank comprising:

a top wall panel having side edges spaced from one another by a distance less than the distance between the outer edges of the tray flanges when said flanges are in said extended position thereof, but greater than the distance between the inner edges of the tray flanges;

first and second side wall panels extending from opposite side edges of said top wall panel, said side wall panels having a width approximately equal to the height of the tray; and a bottom wall panel assembly comprising first and second panels extending from the edges of said side wall panels, said panels including means for interlocking their surfaces in overlapping relation.

13. A blank as defined in claim 12 wherein said interlocking means comprises at least one protruding tab on one of said panels and at least one aligned cut through the other of said panels.

* * * * *